US012522961B2

(12) United States Patent
Minehardt

(10) Patent No.: US 12,522,961 B2
(45) Date of Patent: Jan. 13, 2026

(54) DURABLE PILLING RESISTANT NONWOVEN INSULATION

(71) Applicant: PRIMALOFT, INC., Latham, NY (US)

(72) Inventor: Jon-Alan Minehardt, Clifton Park, NY (US)

(73) Assignee: PRIMALOFT, INC., Latham, NY (US)

( * ) Notice: Subject to any disclaimer, the term of this patent is extended or adjusted under 35 U.S.C. 154(b) by 327 days.

(21) Appl. No.: 18/546,719

(22) PCT Filed: Feb. 16, 2022

(86) PCT No.: PCT/US2022/016572
§ 371 (c)(1),
(2) Date: Aug. 16, 2023

(87) PCT Pub. No.: WO2022/177969
PCT Pub. Date: Aug. 25, 2022

(65) Prior Publication Data

US 2024/0133093 A1 Apr. 25, 2024
US 2024/0229313 A9 Jul. 11, 2024

Related U.S. Application Data

(60) Provisional application No. 63/150,311, filed on Feb. 17, 2021.

(51) Int. Cl.
*D04H 1/4382* (2012.01)
*D04H 1/435* (2012.01)
(Continued)

(52) U.S. Cl.
CPC ..... *D04H 1/43835* (2020.05); *D04H 1/435* (2013.01); *D04H 1/43825* (2020.05);
(Continued)

(58) Field of Classification Search
CPC ..... D04H 1/43835; D04H 1/43825; D04H 1/43918; D04H 1/43914; D04H 1/435;
(Continued)

(56) References Cited

U.S. PATENT DOCUMENTS 4,304,817 A 12/1981 Frankosky
4,520,066 A * 5/1985 Athey ..... D04H 1/43828 428/362
(Continued)

FOREIGN PATENT DOCUMENTS

CN 1277641 A 12/2000
CN 101476212 A 7/2009
(Continued)

OTHER PUBLICATIONS

International Search Report and Written Opinion of International Application No. PCT/US2022/016572, mailed on May 31, 2022, 13 pages.

*Primary Examiner* — Jeremy R Pierce
(74) *Attorney, Agent, or Firm* — HESLIN ROTHENBERG FARLEY & MESITI P.C.

(57) ABSTRACT

Provided is batting that includes a bonded nonwoven web made from a fiber mixture containing: (a) 20 to 55 wt % of siliconized fibers having a denier of 1.5 to 10.0 and a length of 51 mm to 84 mm; (b) 10 to 45 wt % of hollow conjugate fibers having a spiral crimp, and having a denier of 1.5 to 10.0 and a length of 51 to 84 mm; (c) 10 to 45 wt % of a first population of binder fibers which are elastomeric co-polyester binder fibers having a denier of 1.5 to 8.0, a length of 51 mm to 84 mm, and a bonding temperature of 110° C. to 180° C.; and (d) 1 to 20 wt % of a second population of binder fibers, which have a denier of 1.5 to 6.0, a length of 51 mm to 84 mm, and a bonding temperature of 80° C. to 135° C.

20 Claims, 3 Drawing Sheets

(51) Int. Cl.
*D04H 1/4391* (2012.01)
*D04H 1/55* (2012.01)

(52) U.S. Cl.
CPC ..... *D04H 1/43914* (2020.05); *D04H 1/43918* (2020.05); *D04H 1/55* (2013.01); *D10B 2401/04* (2013.01); *D10B 2401/061* (2013.01)

(58) Field of Classification Search
CPC . D04H 1/55; D10B 2401/04; D10B 2401/061
See application file for complete search history.

(56) References Cited

U.S. PATENT DOCUMENTS

| | | | | |
|---|---|---|---|---|
| 5,527,600 | A * | 6/1996 | Frankosky ..... | D04H 1/435 442/164 |
| 2004/0116024 | A1 | 6/2004 | Zafiroglu et al. | |
| 2017/0370037 | A1 | 12/2017 | Mason | |
| 2019/0271104 | A1 * | 9/2019 | Mason ..... | D04H 1/43838 |
| 2019/0309456 | A1 | 10/2019 | Uehata et al. | |
| 2019/0335830 | A1 | 11/2019 | Strangeland et al. | |

FOREIGN PATENT DOCUMENTS

| | | | |
|---|---|---|---|
| CN | 107407027 | A | 11/2017 |
| CN | 107429454 | A | 12/2017 |
| EP | 0069347 | A1 | 1/1983 |
| EP | 0088191 | A2 | 9/1983 |
| EP | 0137101 | A1 | 4/1985 |
| JP | H09173672 | A | 7/1997 |
| JP | 2001026245 | A | 1/2001 |
| JP | 2002223899 | A | 8/2002 |
| TW | 200612002 | A | 4/2006 |
| TW | 201546341 | A | 12/2015 |
| TW | 201641767 | A | 12/2016 |
| WO | 99/10573 | A1 | 3/1999 |
| WO | 2016/118614 | A1 | 7/2016 |

* cited by examiner

DURABLE PILLING RESISTANT NONWOVEN INSULATION

CROSS REFERENCE TO RELATED APPLICATIONS

This application is a national stage filing under Section 371 of International Application No. PCT/US2022/016572, filed on Feb. 16, 2022, and published on Aug. 25, 2022 as WO 2022/177969, which claims the benefit of U.S. provisional application No. 63/150,311, filed on Feb. 17, 2021. The entire contents of WO 2022/177969 and U.S. provisional application No. 63/150,311 are hereby incorporated by reference herein.

FIELD OF THE INVENTION

The present invention generally relates to durable, pilling/fiber migration resistant nonwoven insulation, to methods of making the insulation, and to articles comprising the insulation. The insulation is particularly useful in the textile field.

BACKGROUND OF THE INVENTION

Fibers and fill material, including synthetic fibers and natural fill materials (e.g., down) have long been used as insulative materials in the textile field. For example, the outdoor industry has utilized fibers and down in clothing, cold weather apparel, sleeping bags, etc. for many years. However, a disadvantage to using such fibers has been that this type of insulation is highly prone to pilling, or displaying severe fiber migration through fabric surfaces, even when combined with low air permeability downproof fabrics and/or protected by nonwoven scrim materials.

Scrim is an interlining that is often used as a protective layer between insulation and a shell or liner fabric of an article. Fiber migration is the penetration of fiber through the fabric surface such that fiber is present on the face side of the article, which is typically the outside of the article that is exposed to the external environment. Pilling refers to the tendency of fibers to work loose from a fabric surface and form balled or matted particles of fiber that remain attached to the surface of the fabric.

Downproof fabrics are typically defined as fabrics that are tightly woven with thread counts greater than 250 and have an air permeability rating according to ASTM D737 less than 1 cubic feet per minute (CFM). Sometimes fabrics have coatings applied to them or are calendared to seal their surface as a means to reduce fiber migration and/or achieve downproofness. These treatments further reduce the air permeability of the fabric, which has a direct effect on the overall comfort of an article. The lower the air permeability of the fabric, the less breathable and comfortable it is. The higher the air permeability of the fabric, the more breathable and comfortable it is.

Certain types of migration resistant insulation for use in the textile field are known in the art. These insulations are typically comprised predominantly of higher denier fibers in excess of 1.0 denier and do not contain hydrophobic finishes. Migration resistant surfaces have been created on these types of commonly produced generic insulations using commercially available chemical resins as bonding agents on the surface of the insulation. However, there are a variety of disadvantages associated with this type of treatment, including the fact that the treatments make the insulation stiff and crunchy to the hand feel, reduce stretch, and are not comfortable to wear. Further, most commercially available chemical resins used to create migration resistant surfaces adsorb water quickly, which represents a considerable disadvantage for textiles such as outdoor articles that require both performance and comfort.

Thus, a need exists for improved insulation having desirable properties, but also having improved resistance or prevention of fiber migration (including pilling).

While certain aspects of conventional technologies have been discussed to facilitate disclosure of the invention, Applicant in no way disclaims these technical aspects, and it is contemplated that the claimed invention may encompass one or more of the conventional technical aspects discussed herein.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

Briefly, the present invention satisfies the need for improved insulation that is resistant to fiber migration and pilling, yet offers exceptional properties, including insulative properties and water uptake properties. The present invention may address one or more of the problems and deficiencies of the art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

Applicant has surprisingly found that certain embodiments of the inventive insulation comprising the fiber mixture discussed herein have desirable properties, including good thermal properties, good water pickup properties (i.e., the embodiments do not adsorb unacceptable amounts of water), quick drying times, and resistance to, or prevention of fiber migration and/or pilling.

In a first aspect, the invention provides batting comprising a bonded nonwoven web, said batting having a first surface parallel to a second surface, and said bonded nonwoven web comprising a fiber mixture containing, based on the total weight of the fiber mixture:

(a) 20 to 55 wt % of siliconized fibers having a denier of 1.5 to 10.0 and a length of 51 mm to 84 mm;

(b) 10 to 45 wt % of hollow conjugate fibers having a spiral crimp, and having a denier of 1.5 to 10.0 and a length of 51 to 84 mm;

(c) 10 to 45 wt % of a first population of binder fibers, said first population of binder fibers being elastomeric copolyester binder fibers having a denier of 1.5 to 8.0, a length of 51 mm to 84 mm, and a bonding temperature of 110° C. to 180° C.; and (d) 1 to 20 wt % of a second population of binder fibers different from the first population of binder fibers, said second population of binder fibers having a denier of 1.5 to 6.0, a length of 51 mm to 84 mm, and a bonding temperature of 80° C. to 135° C.;

wherein fibers in the fiber mixture are homogenously mixed.

In a second aspect, the invention provides an article comprising the batting according to the first aspect of invention.

In a third aspect, the invention provides a method of making the batting according to the first aspect of invention or the article according to the second aspect of the invention. The method comprises:

preparing the inventive fiber mixture by mixing:

(a) 20 to 55 wt % of siliconized fibers having a denier of 1.5 to 10.0 and a length of 51 mm to 84 mm;

(b) 10 to 45 wt % of hollow conjugate fibers having a spiral crimp, and having a denier of 1.5 to 10.0 and a length of 51 to 84 mm;

(c) 10 to 45 wt % of a first population of binder fibers, said first population of binder fibers being elastomeric co-polyester binder fibers having a denier of 1.5 to 8.0, a length of 51 mm to 84 mm, and a bonding temperature of 110° C. to 180° C.; and (d) 1 to 20 wt % of a second population of binder fibers different from the first population of binder fibers, said second population of binder fibers having a denier of 1.5 to 6.0, a length of 51 mm to 84 mm, and a bonding temperature of 80° C. to 135° C.;

forming a nonwoven web from the fiber mixture (e.g., via carding);

providing the nonwoven web, or optionally layering (e.g., crosslapping) the nonwoven web formed from the fiber mixture with one or more (e.g., 1, 2, 3, 4, or 5) additional nonwoven webs;

heating the nonwoven web(s) to or in excess of a highest binder fiber bonding temperature, thereby forming batting or a batting intermediate comprising one or more nonwoven webs, including at least the bonded nonwoven web comprising the fiber mixture, said batting or batting intermediate having a first surface parallel to a second surface;

optionally applying a resin solution to the first and second surfaces of the batting intermediate;

optionally heating the batting intermediate to a temperature in excess of the glass transition temperature of the resin in the resin solution; and optionally calendaring one or more surface of the batting intermediate, thereby forming the batting.

Certain embodiments of the presently-disclosed batting, articles comprising the batting, and methods of making the batting have several features, no single one of which is solely responsible for their desirable attributes. Without limiting the scope of the batting, articles and methods as defined by the claims that follow, their more prominent features will now be discussed briefly. After considering this discussion, and particularly after reading the section of this specification entitled "Detailed Description of the Invention," one will understand how the features of the various embodiments disclosed herein provide a number of advantages over the current state of the art. For example, embodiments of the invention provide improved insulation (batting) that significantly reduces and/or prevents pilling and/or fiber migration. Such insulations finds use in, inter alia, the textile field, for example, in clothing, outerwear, home furnishings, bedding, etc.

These and other features and advantages of this invention will become apparent from the following detailed description of the various aspects of the invention taken in conjunction with the appended claims and the accompanying drawings.

BRIEF DESCRIPTION OF THE DRAWINGS

The present invention will hereinafter be described in conjunction with the following drawing figures, which are not necessarily drawn to scale.

DETAILED DESCRIPTION OF THE INVENTION

Aspects of the present invention and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the invention in detail. It should be understood, however, that the detailed description and the specific example(s), while indicating embodiments of the invention, are given by way of illustration only, and are not by way of limitation. Various substitutions, modifications, additions and/or arrangements within the spirit and/or scope of the underlying inventive concepts will be apparent to those skilled in the art from this disclosure.

In a first aspect, the invention provides batting comprising a bonded nonwoven web, said batting having a first surface parallel to a second surface, and said bonded nonwoven web comprising a fiber mixture containing, based on the total weight of the fiber mixture:

(a) 20 to 55 wt % of siliconized fibers having a denier of 1.5 to 10.0 and a length of 51 mm to 84 mm;

(b) 10 to 45 wt % of hollow conjugate fibers having a spiral crimp, and having a denier of 1.5 to 10.0 and a length of 51 to 84 mm;

(c) 10 to 45 wt % of a first population of binder fibers, said first population of binder fibers being elastomeric co-polyester binder fibers having a denier of 1.5 to 8.0, a length of 51 mm to 84 mm, and a bonding temperature of 110° C. to 180° C.; and (d) 1 to 20 wt % of a second population of binder fibers different from the first population of binder fibers, said second population of binder fibers having a denier of 1.5 to 6.0, a length of 51 mm to 84 mm, and a bonding temperature of 80° C. to 135° C.;

wherein fibers in the fiber mixture are homogenously mixed.

Figure 1:
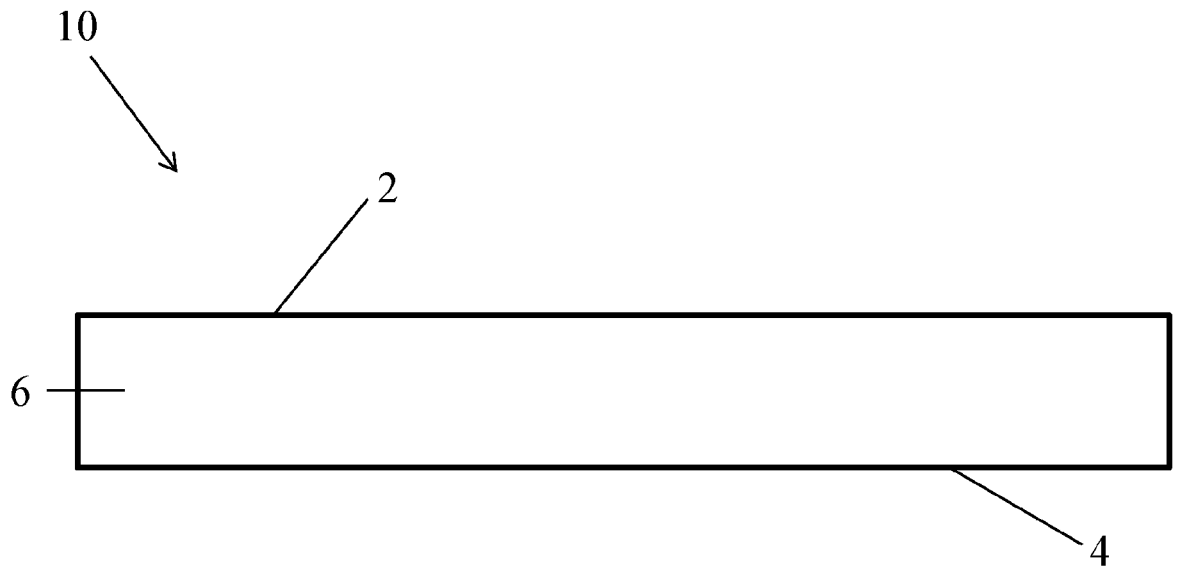
FIG. 1 illustrates a side cross-sectional view of an embodiment of the inventive batting.

FIG. 1 illustrates a side cross-sectional view of an embodiment of the inventive batting 10. The batting 10 comprises a first surface 2 parallel to a second surface 4. The embodiment of batting 10 comprises a single bonded nonwoven web 6, which comprises a fiber mixture (which may be referred to herein as the "inventive fiber mixture") that contains, based on the total weight of the fiber mixture: (a) 20 to 55 wt % of siliconized fibers having a denier of 1.5 to 10.0 and a length of 51 mm to 84 mm; (b) 10 to 45 wt % of hollow conjugate fibers having a spiral crimp, and having a denier of 1.5 to 10.0 and a length of 51 to 84 mm; (c) 10 to 45 wt % of a first population of binder fibers, said first population of binder fibers being elastomeric co-polyester binder fibers having a denier of 1.5 to 8.0, a length of 51 mm to 84 mm, and a bonding temperature of 110° C. to 180° C.; and (d) 1 to 20 wt % of a second population of binder fibers different from the first population of binder fibers, said second population of binder fibers having a denier of 1.5 to 6.0, a length of 51 mm to 84 mm, and a bonding temperature of 80° C. to 135° C.

Figure 2:
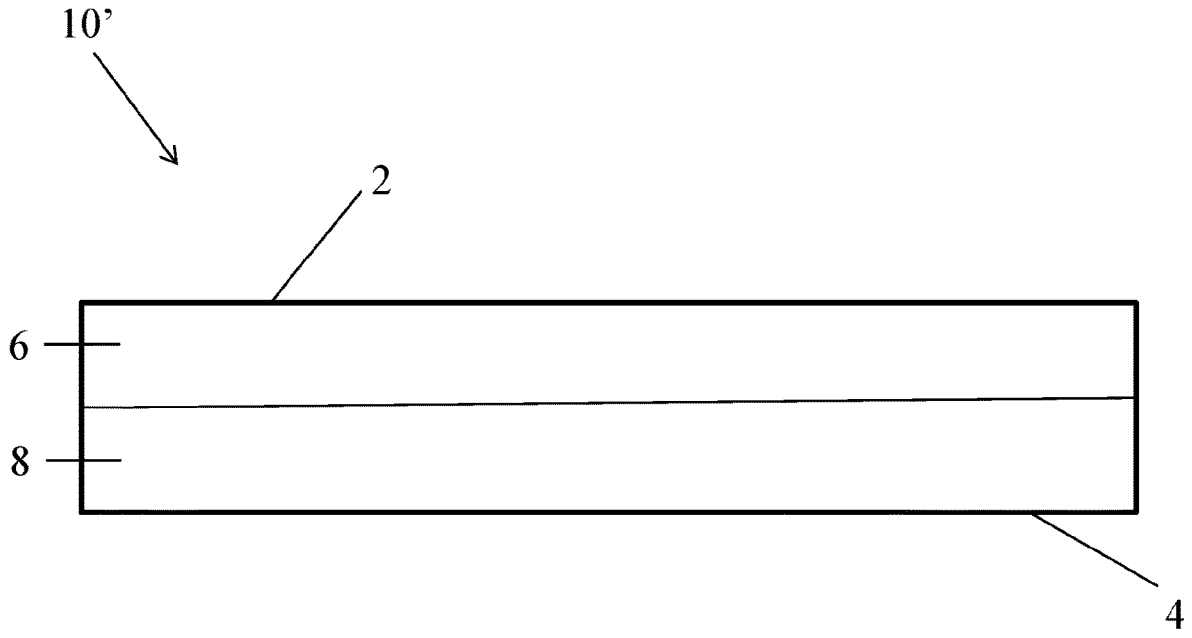
FIG. 2 illustrates a side cross-sectional view of an embodiment of the inventive batting.

Embodiments of the inventive batting contain one or more bonded nonwoven webs (e.g., 1, 2, 3, 4, 5, 6, etc.). In FIG. 1, batting 10 comprises a single bonded nonwoven web 6. In the depicted batting, the first surface 2 and second surface 4 of the batting 10 are likewise the opposite parallel surfaces of the bonded nonwoven web 6. On the other hand, FIG. 2 illustrates a side cross-sectional view of an embodiment of the inventive batting 10', which comprises two bonded nonwoven webs 6, and 8, which have been crosslapped with one another. In embodiments comprising more than one nonwoven web, at least one nonwoven web comprises the inventive fiber mixture. In some embodiments, the majority of nonwoven webs comprised within the batting comprise the inventive fiber mixture. In some embodiments, all nonwoven web(s) comprised within the batting comprise the inventive fiber mixture.

Denier is a unit of measure defined as the weight in grams of 9000 meters of a fiber or yarn. It is a common way to specify the weight (or size) of the fiber or yarn. For example, polyester fibers that are 1.0 denier typically have a diameter of approximately 10 micrometers.

a) Siliconized Fibers Having a Denier of 1.5 to 10.0 and a Length of 51 mm to 84 Mm.

The inventive fiber mixture comprises 20 to 55 wt % of siliconized fibers having a denier of 1.5 to 10.0 and a length of 51 mm to 84 mm (referred to at times herein as "siliconized fibers (a)"). For example, in some embodiments, the inventive fiber mixture comprises 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, or 55 wt % of the siliconized fibers (a), including any and all ranges and subranges therein (e.g., 20-45 wt %, 20-40 wt %, 25-35 wt %, etc.).

As used herein, the term "siliconized" means that the fiber is coated with a silicon-comprising composition (e.g., a silicone). Siliconization techniques are well known in the art, and are described, e.g., in U.S. Pat. No. 3,454,422. The silicon-comprising composition may be applied using any method known in the art, e.g., spraying, mixing, dipping, padding, etc. The silicon-comprising (e.g., silicone) composition, which may include an organosiloxane or polysiloxane, bonds to an exterior portion of the fiber. In some embodiments, the silicone coating is a polysiloxane such as a methylhydrogenpolysiloxane, modified methylhydrogenpolysiloxane, polydimethylsiloxane, or amino modified dimethylpolysiloxane. As is known in the art, the silicon-comprising composition may be applied directly to the fiber, or may be diluted with a solvent as a solution or emulsion, e.g. an aqueous emulsion of a polysiloxane, prior to application. Following treatment, the coating may be dried and/or cured. As is known in the art, a catalyst may be used to accelerate the curing of the silicon-comprising composition (e.g., polysiloxane containing Si—H bonds) and, for convenience, may be added to a silicon-comprising composition emulsion, with the resultant combination being used to treat the synthetic fiber. Suitable catalysts include iron, cobalt, manganese, lead, zinc, and tin salts of carboxylic acids such as acetates, octanoates, naphthenates and oleates. In some embodiments, following siliconization, the fiber may be dried to remove residual solvent and then optionally heated to between 650 and 200° C. to cure.

The siliconized fibers (a) have a denier of 1.5 to 10.0, for example, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, or 10.0 denier, including any and all ranges and subranges therein (e.g., 2 to 10 denier, 3 to 10 denier, 4 to 10 denier, 5 to 10 denier, 6 to 10 denier, 5 to 9 denier, 6 to 8 denier, 6.5 to 7.5 denier, etc.).

The siliconized fibers (a) have a length of 51 mm to 84 mm, for example, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, or 84 mm, including any and all ranges and subranges therein (e.g., 60 to 84 mm, 65 to 84 mm, 70 to 80 mm, etc.).

In some embodiments, the siliconized fibers (a) are hollow fibers. In some embodiments, the siliconized fibers (a) are solid (not hollow) fibers.

In some embodiments, the siliconized fibers (a) are polymeric fibers. In particular embodiments, the siliconized fibers (a) are polyester fibers. In some embodiments, the siliconized fibers (a) comprise recycled polyester (for example, post-consumer recycled (PCR) polyester).

(b) Hollow Conjugate Fibers Having a Spiral Crimp, and Having a Denier of 1.5 to 10.0 and a Length of 51 to 84 mm The inventive fiber mixture comprises 10 to 45 wt % hollow conjugate fibers having a spiral crimp, and having a denier of 1.5 to 10.0 and a length of 51 to 84 mm (referred to at times herein as "hollow conjugate fibers (b)"). For example. in some embodiments, the inventive fiber mixture comprises 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, or 45 wt % of the hollow conjugate fibers (b), including any and all ranges and subranges therein (e.g., 15-45 wt %, 20-40 wt %, 25-35 wt %, etc.).

The hollow conjugate fibers (b) have a spiral (helical) crimp.

The hollow conjugate fibers (b) have a denier of 1.5 to 10.0, for example, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, or 10.0 denier, including any and all ranges and subranges therein (e.g., 2 to 10 denier, 3 to 10 denier, 4 to 10 denier, 5 to 10 denier, 6 to 10 denier, 5 to 9 denier, 6 to 8 denier, 6.5 to 7.5 denier, etc.).

The hollow conjugate fibers (b) have a length of 51 to 84 mm, for example, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, or 84 mm, including any and all ranges and subranges therein (e.g., 51-75 mm, 55-75 mm, 60-70 mm, etc.).

The hollow conjugate fibers (b) may be siliconized or dry (i.e., not siliconized). In some embodiments, the hollow conjugate fibers (b) are dry, and have not been treated with any surface chemistry(ies). In some embodiments, the hollow conjugate fibers (b) have been treated with surface chemistry(ies) (e.g., they are siliconized).

In some embodiments, the conjugate fibers (b) are polymeric fibers. In particular embodiments, the conjugate fibers (b) are polyester fibers. In some embodiments, the conjugate fibers (b) comprise recycled polyester (for example, PCR polyester).

First Population of Binder Fibers.

The inventive fiber mixture comprises 10 to 45 wt % of a first population of binder fibers, said first population of binder fibers being elastomeric co-polyester binder fibers having a denier of 1.5 to 8.0, a length of 51 mm to 84 mm, and a bonding temperature of 110° C. to 180° C. (referred to at times herein as "binder fibers (c)").

In some embodiments, the inventive fiber mixture comprises 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, or 45 wt % binder fibers (c), including any and all ranges and subranges therein (e.g., 15-40 wt %, 20-40 wt %, 25-35 wt %, etc.).

In some embodiments, the binder fibers (c) have a high elongation at break (e.g., of 200%-800%, for example, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, or 800%, including any and all ranges and subranges therein). Elongation at break refers to the percent increase in length of a fiber when it is stretched to the point at which it breaks.

In some embodiments, the binder fibers (c) have an elongation at break of, e.g., at least 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, or 800%. In some embodiments, the binder fibers (c) recover fully within 5 minutes of being elongated to 200-800% (e.g., 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, or 800%) of their original length.

The binder fibers (c) have a denier of 1.5 to 8.0, for example, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, or 8.0 denier, including all ranges and subranges therein (e.g., 2-8 denier, 3-8 denier, 4-7.5 denier, 5-7 denier, etc.), The binder fibers (c) have a length of 51 mm to 84 mm, for example, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, or 84 mm, including any and all ranges and subranges therein (e.g., 51-75 mm, 55-75 mm, 60-70 mm, etc.).

The binder fibers (c) have a bonding temperature of 110° C. to 180° C., for example, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, or 180° C., including any and all ranges and subranges therein (e.g., 120-170° C., 125-160° C., etc.).

The binder fibers (c) are co-polyester fibers comprising two different polyester components.

In some embodiments, binder fibers (c) comprise an inner polyester component and an outer polyester elastomer component. In such embodiments and certain other embodiments, the binder fibers (c) are considered to be 100% polyester fibers.

In some embodiments, binder fibers (c) comprise an inner polyester component and an outer polyester elastomer component that has a lower melting point than the inner polyester component.

Figure 3A:
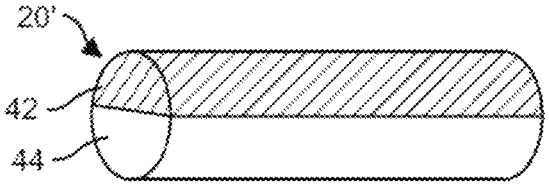
FIGS. 3A-F depict non-limiting examples of cross-sections that bicomponent binder fibers used in certain embodiments of the invention can have.
Figure 3B:
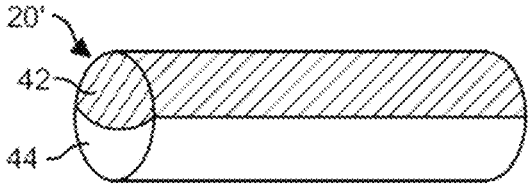
Figure 3C:
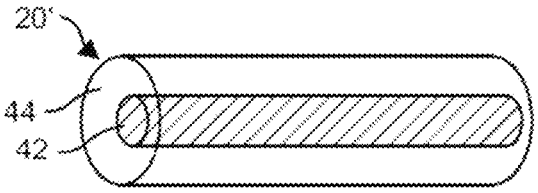
Figure 3D:
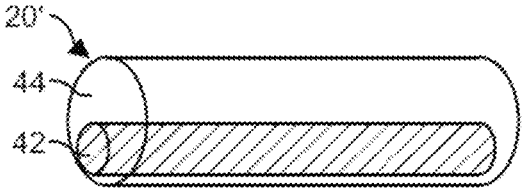
Figure 3E:
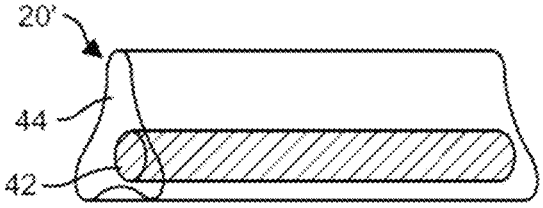
Figure 3F:
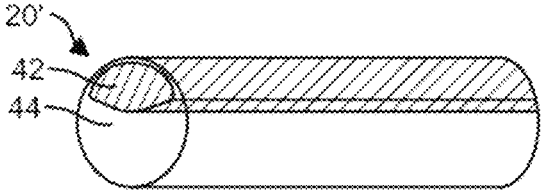

FIGS. 3A-F depict non-limiting examples of cross-sections that bicomponent binder fibers (e.g. used as binder fibers (c), or binder fibers (d)) used in certain embodiments of the invention can have. In FIG. 3A, the core 42 and sheath 44 are in a 50:50 ratio and are in a side-by-side arrangement. As used herein, the term "core" refers to a foundational part of the bicomponent fiber that is distinct from the sheath portion. In various embodiments, the core may be at the center, innermost part of the bicomponent fiber. However, in other embodiments, the core may be off-centered, or present at at least a portion of a peripheral surface of the bicomponent fiber. In FIG. 3B the core 42 and sheath 44 are in an unequal radio and are in a side-by-side arrangement. Further, the interface between the core 42 and sheath 44 is not planar. In FIGS. 3C-3F, the core 42 and sheath 44 are in a concentric arrangement, where core 42 forms an interior portion of bicomponent fiber 20' and is surrounded by sheath 44. In the non-limiting embodiments shown in FIGS. 3A to 3E, the core 42 is asymmetrically placed relative to the sheath 44 (i.e., the core 42 is symmetrically off-set within the bicomponent fiber 20'). In FIGS. 3C-3F, the core 42 is off-center (i.e., displaced from a center point or axis of the fiber) but still fully surrounded by the sheath 44. FIG. 3E shows a tri-lobal fiber 20'. The arrangements shown in FIGS. 3C-3F are also known as "sea island" or "island in sea" configurations. Persons having ordinary skill in the art will understand that these are arrangements that are not limited and may include further components or additional "islands".

Second Population of Binder Fibers.

The inventive fiber mixture comprises 1 to 20 wt % of a second population of binder fibers different from the first population of binder fibers, said second population of binder fibers having a denier of 1.5 to 6.0, a length of 51 mm to 84 mm, and a bonding temperature of 80° C. to 135° C. (referred to at times herein as "binder fibers (d)").

The inventive fiber mixture comprises 1 to 20 wt % binder fibers (d), for example, 1, 2, 3, 4, 5, 6, 7, 8, 9, 10, 11, 12, 13, 14, 15, 16, 17, 18, 19, or 20 wt % binder fibers (d), including any and all ranges and subranges therein (e.g., 2-18 wt %, 3-17 wt %, 4-16 wt %, 5-15 wt %, etc.).

The binder fibers (d) have a denier of 1.5 to 6.0, for example, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, or 6.0 denier, including any and all ranges and subranges therein (e.g., 1.5-5 denier, 1.5-4 denier, 1.5-3 denier, etc.).

The binder fibers (d) have a length of 51 mm to 84 mm, for example, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, or 84 mm, including any and all ranges and subranges therein (e.g., 51-75 mm, 51-70 mm, 51-65 mm, 51 to 60 mm, etc.).

The binder fibers (d) have a bonding temperature of 80° C. to 135° C., for example, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, or 135° C., including any and all ranges and subranges therein (e.g., 90-125° C., 95-115° C., etc.).

In some embodiments, the binder fibers (d) are polymeric fibers. In particular embodiments, the binder fibers (d) comprise polyester. In some embodiments, the binder fibers (d) comprise recycled polyester (for example, PCR polyester).

Binder fibers are well known in the art, and an array of binder fibers are commercially available. The binder fibers (d) used in the present invention may be conventional binder fibers (e.g., low-melt polyester binder fibers), or other binder fibers, provided that whatever binder fiber is used, the binder fiber has a bonding temperature lower than the softening temperature of the siliconized fibers (a) and the hollow conjugate fibers (b). Binder fibers are discussed, for example, in U.S. Pat. No. 4,794,038, and general protocols for certain embodiments of binder fibers are set forth in U.S. Pat. No. 4,281,042 and in U.S. Pat. No. 4,304,817. In some embodiments, the binder fibers (d) are monocomponent fibers. In some embodiments, the binder fibers (d) are multicomponent fibers (e.g., bicomponent fibers, for example, sheath-core fibers, where the core comprises a higher melting component than the sheath). In some embodiments, the binder fibers (d) are bicomponent fibers having one of the non-limiting configurations illustrated in FIGS. 3A-F.

The inventive batting, in some embodiments, has been heat treated so as to melt all or a portion of the binder fibers therein, thereby forming a bonded non-woven web-type batting. Persons having ordinary skill in the art will understand that, although "binder fibers" are recited in the fiber mixture of the batting, the binder fibers may be wholly or partially melted fibers, as opposed to binder fibers in their original, pre-heat treatment form.

In embodiments of the inventive batting, the siliconized fibers (a), hollow conjugate fibers (b), binder fibers (c), and binder fibers (d) are each separate and distinct, mutually exclusive fiber populations.

In the inventive fiber mixture, the fiber constituents, including siliconized fibers (a), hollow conjugate fibers (b), binder fibers (c), and binder fibers (d), are mixed (e.g., homogenously mixed). As will be appreciated by persons having ordinary skill in the art, mixing the fibers typically results in a homogenous mixture.

In some embodiments, the inventive fiber mixture is a substantially uniform (i.e., 90-100% uniform) composition.

In some embodiments, the inventive fiber mixture consists of siliconized fibers (a), hollow conjugate fibers (b), binder fibers (c), and binder fibers (d).

In some embodiments, at least 90 wt % (e.g., at least 90, 91, 92, 93, 94, 95, 96, 97, 98, 99, or 99.5 wt %) of the inventive fiber mixture is made up from the sum wt %'s of siliconized fibers (a), hollow conjugate fibers (b), binder fibers (c), and binder fibers (d). For example, where the sum wt % of siliconized fibers (a), hollow conjugate fibers (b), binder fibers (c), and binder fibers (d) is 90 wt % of the fiber mixture, then 10 wt % of the fiber mixture could be made up from other fiber constituents.

Unless otherwise specified, fibers used in the inventive batting may be crimped or uncrimped. Various crimps, including spiral and standard crimp, are known in the art.

Unless otherwise specified, fibers used in the inventive batting can have any desired shape for a cross section (e.g., circular or other).

In some embodiments, the inventive fiber mixture comprises, based on the weight of the fiber mixture:

20 to 40 wt % of the siliconized fibers (a) (e.g., 20, 21, 22, 23, 24, 25, 26, 27, 28, 29, 30, 31, 32, 33, 34, 35, 36, 37, 38, 39, or 40 wt %, including any and all ranges and subranges therein); and/or:

20 to 40 wt % of the hollow conjugate fibers (b) (e.g., 20, 21, 22, 23, 24, 25, 26, 27, 28, 29, 30, 31, 32, 33, 34, 35, 36, 37, 38, 39, or 40 wt %, including any and all ranges and subranges therein); and/or 20 to 40 wt % of the first population of binder fibers (c) (e.g., 20, 21, 22, 23, 24, 25, 26, 27, 28, 29, 30, 31, 32, 33, 34, 35, 36, 37, 38, 39, or 40 wt %, including any and all ranges and subranges therein); and/or 5 to 15 wt % of the second population of binder fibers (d) (e.g., 5, 6, 7, 8, 9, 10, 11, 12, 13, 14, or 15 wt %, including any and all ranges and subranges therein).

In some embodiments of the inventive fiber mixture:

the siliconized fibers (a) have a denier of 3.0 to 10.0 (e.g., 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, or 10.0 denier, including any and all ranges and subranges therein); and/or the hollow conjugate fibers (b) have a denier of 3.0 to 10.0 (e.g., 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, or 10.0 denier, including any and all ranges and subranges therein); and/or the first population of binder fibers (c) have a denier of 3.0 to 8.0 (e.g., 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, or 8.0 denier, including any and all ranges and subranges therein); and/or the second population of binder fibers (d) have a denier of 1.5 to 4.0 (e.g., 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or 4.0 denier, including any and all ranges and subranges therein).

In some embodiments, the inventive fiber mixture can comprise synthetic fibers and optionally natural fibers.

In some embodiments, the inventive fiber mixture of the batting comprises natural fibers. For example, in some embodiments, the fiber mixture comprises one or more members selected from wool, cotton, tencel, kapok (cotton-like fluff obtained from seeds of a Kapok tree, which may optionally be further processed before use), flax, animal hair, silk, and down (e.g., duck or goose down).

In some embodiments, the inventive fiber mixture comprises natural and/or synthetic polymeric fibers.

Many synthetic fibers are known in the art, and it is contemplated that any art-accepted desired synthetic fibers may be used in the invention. Indeed, different fibers have different properties, and lend themselves toward advantageous uses in different applications. This information is well within the purview of persons having ordinary skill in the art. While a wide array of synthetic fibers may be used in the invention, in some embodiments, the synthetic fibers are selected from the group consisting of polyamide (e.g., nylon/polyamide 6.6, polyamide 6, polyamide 4, polyamide 11, and polyamide 6.10, etc.), polyester, polybutylene terephthalate (PBT), polypropylene, polylactic acid (also known as polylactide) (PLA), poly(butyl acrylate) (PBA), acrylic, acrylate, acetate, polyolefin, nylon, rayon, lyocell, aramid, spandex, viscose, and modal, biopolymer fibers (e.g., polyhydroxyalkanoates (PHA), poly-(hydroxybutyrate-covalerate) (PHBV)), and combinations thereof.

In particular embodiments, the inventive fiber mixture comprises polyester synthetic fibers. In some embodiments, such polyester fibers comprise one or more of polyethylene terephthalate (PET), poly(hexahydro-p-xylylene terephthalate), polybutylene terephthalate (PBT), poly-1,4-cyclohexelyne dimethylene (PCDT) and terephthalate copolyesters in which at least 85 mole percent of the ester units are ethylene terephthalate or hexahydro-p-xylylene terephthalate units. In a particular embodiment, the synthetic fibers are polyethylene terephthalate fibers.

In some embodiments, the inventive batting comprises 4 to 15 wt % resin, based on the total weight of the batting. For example, in some embodiments, the batting comprises 4, 5, 6, 7, 8, 9, 10, 11, 12, 13, 14, or 15 wt % resin, including any and all ranges and subranges therein (e.g., 6-10 wt %).

In some embodiments, the first and/or second surface of the batting comprises 2 to 8 wt % resin, based on the total weight of the batting, for example, 2, 3, 4, 5, 6, 7, or 8 wt %, including any and all ranges and subranges therein (e.g., 2-5 wt %).

In some embodiments, the inventive batting has an area weight of 25 to 60 g/m$^2$, for example, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 g/m$^2$, including any and all ranges and subranges therein (e.g., 30-40 g/m$^2$).

In some embodiments, the inventive batting has a density of 5 to 15 kg/m$^3$, for example, 5, 6, 7, 8, 9, 10, 11, 12, 13, 14, or 15 kg/m$^3$, including any and all ranges and subranges therein (e.g., 5-14 kg/m$^3$, 13-14 kg/m$^3$, etc.).

In some embodiments, the batting has a thickness of 3 mm to 100 mm (e.g., 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, or 100 mm), including any and all range and subranges therein.

Clo (clo/oz/yd2) is a unit used to measure the thermal resistance of clothing or other insulative articles. A value of 1.0 clo is defined as the amount of insulation that allows a person at rest to maintain thermal equilibrium in an environment at 21° C. (70° F.) in a normally ventilated room (0.1 m/s air movement). Typically, above this temperature the person so dressed will sweat, whereas below this temperature the person will feel cold. Articles such as clothing and/or its components (e.g., insulation, such as batting) can be assigned a clo value. Higher clo indicates an article is warmer than another article with a comparatively lower clo.

In some embodiments, the inventive batting has a warmth per weight thermal performance greater than 0.012 clo per g/m$^2$ (for example, greater than 0.012, 0.013, 0.014, 0.015, 0.016, 0.017, 0.018, 0.019, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or 0.50 clo per g/m$^2$) according to ISO 11092, including any and all ranges and subranges therein.

In some embodiments, the inventive batting has a water uptake of less than or equal to 150 wt % (e.g., less than or equal to 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, or 150 wt %) based on the weight of the batting when dry.

In some embodiments, the inventive batting has a water uptake of 50 to 150 wt % (e.g., 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, or 150 wt %), including any and all ranges and subranges therein, based on the weight of the batting when dry.

Embodiments of the inventive batting surprisingly have exceptional resistance to pilling and fiber migration.

In order to prevent the problem of fiber migration from insulative constructs (including batting), in the past excessive resin and/or down-proof fabric have been used in insulative constructs. Truly down-proof fabric is typically a fabric having an air permeability of less than 1 cubic foot per square meter (CFM). Unfortunately, the weight and low air permeability of the fabric in down-proof constructs sacrifices breathability and comfort in the interest of preventing fiber migration.

Applicant has surprisingly discovered that embodiments of the inventive batting rival comparative embodiments prepared using excessive resin and/or down-proof fabric in terms of resisting or preventing fiber migration/pilling, yet are much more comfortable and breathable, making for highly improved textiles. This feature results from the unique composition of the inventive fiber mixture used to make the nonwoven web(s) of the inventive batting.

Persons having ordinary skill in the art typically would not consider subjecting bonded nonwoven batting comprising staple fibers (fibers of definite length, as opposed to filaments of indefinite length) to fiber migration testing. Indeed, according to conventional wisdom, nonwoven insulation should not be able to withstand Martindale testing. The Martindale test procedure, which is done before and after ten times of laundering a sample, is used to determine the fiber migration that would present when the insulation is exposed to rubbing under pressure against different materials like high CFM fabrics, seatbelts, backpacks, harnesses, etc. Normal batting comprising bonded nonwoven web(s) would be severely damaged by this test and would result in excessive fiber migration. Surprisingly, however, embodiments of the inventive batting described herein do not demonstrate surface pilling or fiber migration when subjected to fiber migration testing. This is an all new benchmark for insulation durability. Insulation (such as batting) able to withstand the fiber migration testing described herein can be combined with highly breathable fabrics (high cfm, e.g., 1-500 CFM, including fabrics with textured surfaces) to create exceptionally comfortable and breathable textile articles. The properties of the inventive batting are even further surprising because a person having ordinary skill in the art would expect the presence of the siliconized fibers (a) to be to the detriment of durability (this is because with higher amounts of siliconized fiber, one would expect fewer bonding points, since binder fibers typically do not bond well to siliconized fibers). The presence of these siliconized fibers, which surprisingly does not compromise the fiber migration properties of the insulation, contributes to the beneficial water repellency properties of embodiments of the inventive batting, making for a highly advantageous insulation that is breathable, water repellent, migration resistant, and has good drape (properties conventionally thought to be mutually exclusive of one another—at least one property would have to be compromised to achieve beneficial results for the others).

One test method for determining insulation's fiber migration resistance is the IDFL (International Down and Feather Testing Laboratory) Downproofness-International Rotation Box standard test method. In accordance with that method, a 45.5 cm plastic box tumbler with a door on one side is used. A motor rotates the box at a speed of 48+/−2 revolutions per minute. Twenty-four No. 6.5 solid silicone stoppers are used in the box. A clean sample article is placed in the box, and the box is rotated for 30 minutes. All fibers and clusters are collected from the surface of the article, tumbler box and silicone stoppers. Collection material is evaluated and counted, and a numerical rating of 1 (significant fiber migration) to 5 (little or no fiber migration) is assigned, as shown in Table I, based on the amount of fibers (only fibers >4 mm are counted) that escape or protrude through the fabric of the article after the 30 minute tumbling period.

TABLE I

Fiber Migration Ratings

| Rating | Fibers (>4 mm) |
|---|---|
| 5 | <5 |
| 4 | 6-10 |
| 3 | 11-20 |
| 2 | 21-30 |
| 1 | >31 |

In some embodiments, the inventive batting has a fiber migration rating of 4 or 5 in accordance with the IDFL Downproofness-International Rotation Box standard test method. Good resistance to fiber migration likewise indicates good resistance to pilling, and thus fiber migration resistance as discussed herein includes resistance to pilling.

The "INS-17 Fiber Migration Test" is an Applicant-developed fiber migration resistance test standard that is even more strenuous and exacting than the IDFL Downproofness-International Rotation Box standard test method.

In some embodiments, the inventive batting has a fiber migration resistance of less than 20 fibers when tested according to the INS-17 Fiber Migration Test.

The INS-17 Fiber Migration Test determines the potential for migration of fibers through various types of fabric. The test is described below.

Samples are prepared as follows: a fabric is selected, and folded in half, thereby forming a pillow (about 12"×12") with three sides open. Two sides of the are sewn shut, leaving the side across from the fold unsewn. A piece of insulation (e.g., in this case, an embodiment of the inventive batting) is cut to about 12"×12", so as to fit within the fabric pillow without bunching. The insulation is placed within the pillow, and the last side of the pillow is sewn shut. The pillow is sewn alone the entire outside edges thereof at approximately 0.25 inches from the edge to prevent the insulation from shifting. Sides A and/or B of the pillow are so marked.

The pillow sample is subjected to the testing procedure, which entails:

Cycle 1: The pillow is placed in a residential dryer (with no heat) for 45 a minute cycle with 21 rubber stoppers (such as Herco Black Rubber One-Hole Stoppers, Part Number ST1H-04-BK sold by Hecht Rubber Corporation, which are used in the examples described herein). After completing Cycle 1, both sides of the pillow are closely observed to detect any fiber(s) migrating through the fabric. For examples described herein, the pillow is observed using a dark background and appropriate lighting, and packing tape is utilized to thoroughly scan the surface of the pillow for fiber(s).

Cycle 2: The pillow is placed in a residential washing machine and is subjected to wash cycle on the following settings: regular wash cycle, cold water rinse, small wash load, with two tablespoons of laundry detergent (e.g., Tide). After the wash cycle is complete, the pillow is removed from the washing machine, is placed in the dryer, and is subjected to a dryer cycle on low heat with the 21 rubber stoppers until completely dry. After completing Cycle 2, both sides of the pillow are closely observed to detect any fiber(s) migrating through the fabric. Fiber(s) migrating through the fabric are counted and recorded for both sides of the pillow. For examples described herein, the pillow is observed using a dark background and appropriate lighting, and packing tape is utilized to thoroughly scan the surface of the pillow for fiber(s).

Cycle 3: Cycle 2 is repeated, but without laundry detergent.

Cycle 4: Cycle 2 is repeated, but without laundry detergent.

After completing Cycles 1-4, fabrics are graded as follows:

| Total Number of Fibers Counted | Designation |
|---|---|
| 0 | Migration Resistant |
| 1-2 | Acceptable Migration |
| 3-9 | Mild Migration |
| 10-19 | Moderate Migration |
| 20+ | Severe Migration |

In some embodiments, the inventive batting has a migration resistance of "Migration Resistant" (i.e., 0 fibers counted) or "Acceptable Migration" (i.e., less than 3 fibers counted) according to the INS-17 Fiber Migration Test.

In some embodiments, the batting has stretch or multidirectional stretch of 5 to 30%, including any ranges and subranges therein, in one or more of the machine (MD), cross (CD), and diagonal directions, under a load of 0.65 lbs, when tested according to ASTM D3107. For example, in some embodiments, the batting has a MD, CD, and/or diagonal direction stretch of 5, 6, 7, 8, 9, 10, 11, 12, 13, 14, 15, 16, 17, 18, 19, 20, 21, 22, 23, 24, 25, 26, 27, 28, 29, or 30%.

In some embodiments, the inventive batting has good drape (the insulation hangs under its own weight). An insulation's drape can have a significant bearing on qualities such as comfort and aesthetics of an article within which the insulation may be used. In some embodiments, the insulation has a drape of 1.0 cm to 3.0 cm (e.g., 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0 cm) including any and all ranges and subranges therein (e.g., 1.5 to 2.5 cm, etc.), as measured in accordance with Method ASTM D1388.

In some embodiments, the inventive batting has a compression recovery of greater than 50%, for example, greater than 50, 51, 52, 53, 54, 55, 56, 57, 58, 59, or 60% measured according to ISO 3385.

In some embodiments, the inventive batting has a compression recovery of 50.5 to 70%, for example, 51, 52, 53, 54, 55, 56, 57, 58, 59, 60, 61, 62, 63, 64, 65, 66, 67, 68, 69, or 70%, including any and all ranges and subranges therein (e.g., 50.5 to 68%, 55 to 67%, 60 to 65%, etc.) according to ISO 3385.

In a second aspect, the invention provides an article comprising the batting according to the first aspect of invention.

In some non-limiting embodiments, the article an article of footwear (e.g., shoes, socks, slippers, boots), outerwear (e.g. outerwear garments such as a jacket, coat, vest, shoe, boot, pants (e.g., snow pants, ski pants, etc.) glove, mitten, scarf, headwear, hat, etc.), clothing/apparel (e.g., shirts, pants, undergarments (e.g., underwear, thermal underwear, socks, hosiery, etc.), sleepwear (e.g., pajamas, nightgown, robe, etc.)), activewear (e.g., clothing, including footwear, worn for sport or physical exercise), sleeping bag, bedding (e.g., comforter or quilt), pillow, cushion, pet bed, home good (e.g., an upholstered chair), etc.

In some embodiments, the inventive fiber is comprised within at least a part of one of article.

In some embodiments, the article has an air permeability of 1 CFM to 500 CFM, e.g., 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245, 246, 247, 248, 249, 250, 251, 252, 253, 254, 255, 256, 257, 258, 259, 260, 261, 262, 263, 264, 265, 266, 267, 268, 269, 270, 271, 272, 273, 274, 275, 276, 277, 278, 279, 280, 281, 282, 283, 284, 285, 286, 287, 288, 289, 290, 291, 292, 293, 294, 295, 296, 297, 298, 299, 300, 301, 302, 303, 304, 305, 306, 307, 308, 309, 310, 311, 312, 313, 314, 315, 316, 317, 318, 319, 320, 321, 322, 323, 324, 325, 326, 327, 328, 329, 330, 331, 332, 333, 334, 335, 336, 337, 338, 339, 340, 341, 342, 343, 344, 345, 346, 347, 348, 349, 350, 351, 352, 353, 354, 355, 356, 357, 358, 359, 360, 361, 362, 363, 364, 365, 366, 367, 368, 369, 370, 371, 372, 373, 374, 375, 376, 377, 378, 379, 380, 381, 382, 383, 384, 385, 386, 387, 388, 389, 390, 391, 392, 393, 394, 395, 396, 397, 398, 399, 400, 401, 402, 403, 404, 405, 406, 407, 408, 409, 410, 411, 412, 413, 414, 415, 416, 417, 418, 419, 420, 421, 422, 423, 424, 425, 426, 427, 428, 429, 430, 431, 432, 433, 434, 435, 436, 437, 438, 439, 440, 441, 442, 443, 444, 445, 446, 447, 448, 449, 450, 451, 452, 453, 454, 455, 456, 457, 458, 459, 460, 461, 462, 463, 464, 465, 466, 467, 468, 469, 470, 471, 472, 473, 474, 475, 476, 477, 478, 479, 480, 481, 482, 483, 484, 485, 486, 487, 488, 489, 490, 491, 492, 493, 494, 495, 496, 497, 498, 499, or 500 CFM, including any and all ranges and subranges therein.

In a third aspect, the invention provides a method of making the batting according to the first aspect of invention or the article according to the second aspect of the invention, said method comprising:

preparing the inventive fiber mixture by mixing:

(a) 20 to 55 wt % of siliconized fibers having a denier of 1.5 to 10.0 and a length of 51 mm to 84 mm;

(b) 10 to 45 wt % of hollow conjugate fibers having a spiral crimp, and having a denier of 1.5 to 10.0 and a length of 51 to 84 mm;

(c) 10 to 45 wt % of a first population of binder fibers, said first population of binder fibers being elastomeric copolyester binder fibers having a denier of 1.5 to 8.0, a length of 51 mm to 84 mm, and a bonding temperature of 110° C. to 180° C.; and (d) 1 to 20 wt % of a second population of binder fibers different from the first population of binder fibers, said second population of binder fibers having a denier of 1.5 to 6.0, a length of 51 mm to 84 mm, and a bonding temperature of 80° C. to 135° C.;

forming a nonwoven web from the fiber mixture (e.g., via carding);

providing the nonwoven web, or optionally layering (e.g., crosslapping) the nonwoven web formed from the fiber mixture with one or more (e.g., 1, 2, 3, 4, or 5) additional nonwoven webs;

heating the nonwoven web(s) to or in excess of a highest binder fiber bonding temperature, thereby forming batting or a batting intermediate comprising one or more nonwoven webs, including at least the bonded nonwoven web comprising the fiber mixture, said batting or batting intermediate having a first surface parallel to a second surface;

optionally applying a resin solution to the first and/or second surfaces of the batting intermediate;

optionally heating the batting intermediate to a temperature in excess of the glass transition temperature of the resin in the resin solution; and optionally calendaring one or more surface of the batting intermediate, thereby forming the batting.

In some embodiments, after (e.g., directly after) providing the nonwoven web, and optionally layering (e.g., crosslapping) the web, the resultant batting intermediate is subjected to a needling process. Needling is typically performed on a needle loom, which is a machine for bonding a nonwoven web by mechanically orienting fibers through the web. During needling (also called needlepunching), barbed needles set into a board (the "needle board") punch fiber into the battering intermediate and withdraw, thereby leaving the fibers mechanically entangled. While needling is typically used on nonwoven webs to produce dense products (typical needled fabrics include pads, papermaker's felts, padding, linings, etc.), Applicant has found that desirable embodiments of the present invention can be produced by employing a needling process. For example, in some embodiments, the batting intermediate is lightly tacked by subjecting it to needling wherein the needle board is modified to be less dense (i.e., to contain fewer needles than are typically used in needling) and/or to limit the needling, such that the needles only penetrate partially into the batting intermediate. The Applicant has found that such "partial needling" results in embodiments that are less dense than typical needled products, yet have even further improved fiber migration properties.

In some embodiments, a needling process is performed on the batting intermediate prior to performing any of the steps recited above following said "providing the nonwoven web, or optionally layering (e.g., crosslapping) the nonwoven web formed from the fiber mixture with one or more (e.g., 1, 2, 3, 4, or 5) additional nonwoven webs."

EXAMPLES

The invention will now be illustrated, but not limited, by reference to the specific embodiments described in the following examples.

An embodiment of inventive batting is prepared by mixing a fiber mixture comprising:

- 30 wt % siliconized fibers (a) comprising recycled polyethylene and having a denier of 7, and a length of 76 mm;
- 30 wt % dry hollow conjugate fibers (b) comprising recycled polyethylene and having a denier of 7, and a length of 64 mm;
- 30 wt % polymeric binder fibers (c) having a denier of 6, and a length of 64 mm; and
- 10 wt % binder fibers (d) comprising recycled polyethylene and having a denier of 2, and a length of 51 mm;

The fiber mixture is formed into a nonwoven web on a carding machine, which is then heated to bond binder fibers (c) and binder fibers (d), thereby forming a bonded nonwoven web. A 70/30 water/resin solution is applied to both surfaces (sides A and B) of the bonded nonwoven web, which is then heated to a temperature in excess of the glass transition temperature of the resin in the resin solution. The batting intermediate is calendared at 185° C. to form the batting embodiment.

Fiber migration testing is performed on the batting embodiment according to the INS-17 Fiber Migration Test. Results of migration testing on Pillows 1-3 are as follows:

| | # Fibers Protruding Through Sample | | | | % Weight |
|---|---|---|---|---|---|
| | After Dry Cycle | After Laundering Cycle 1 | After Laundering Cycle 2 | After Laundering Cycle 3 | Loss of Batting After Laundering |
| Side A | 0 | 0 | 0 | 0 | 0% |
| Side B | 0 | 0 | 0 | 0 | |

As is readily apparent, despite the rigorous fiber migration test procedure, the inventive batting embodiment demonstrates exceptional resistance to fiber migration. The ability to achieve this level of reduced/prevented fiber migration in the bonded nonwoven batting comprising staple fibers is exceptionally advantageous.

A 40 gsm sample of batting prepared as described above is subjected to Applicant's standard operating procedure corresponding to ASTM D3107. Results are as follows:

| Stretch<br>sample size 11 × 2.5" | | | | | | | | | |
|---|---|---|---|---|---|---|---|---|---|
| | Machine Direction | | | Cross Direction | | | Diagonal Direction | | |
| Inches | Initial | Stretch | Recovery | Initial | Stretch | Recovery | Initial | Stretch | Recovery |
| 1 | 11 | 13⅜ | 11¼ | 11 | 12⅜ | 11⅛ | 11 | 12⅝ | 11⅛ |
| 2 | 11 | 14¼ | 11½ | 11 | 12⅜ | 11⅛ | 11 | 12⅛ | 11 |
| 3 | 11 | 13¾ | 11⅜ | 11 | 12¼ | 11 | 11 | 12⅜ | 11⅛ |
| Average | 11 | 13.79 | 11.38 | 11 | 12.33 | 11.08 | 11 | 12.38 | 11.08 |
| % Change | 25% | | | 12% | | | 13% | | |

A further embodiment of inventive batting is prepared by mixing a fiber mixture comprising:

- 20 wt % siliconized fibers (a) comprising recycled polyethylene terephthalate and having a denier of 6, and a length of 64 mm;
- 50 wt % dry hollow conjugate fibers (b) comprising recycled polyethylene terephthalate and having a denier of 3, and a length of 51 mm;
- 15 wt % polymeric binder fibers (c) having a denier of 6, and a length of 64 mm; and
- 15 wt % binder fibers (d) comprising recycled polyethylene and having a denier of 2, and a length of 51 mm.

The fiber mixture is formed into a nonwoven web on a carding machine, then lightly tacked (i.e., subjected to a partial needling process) to further entangle the fibers, thereby providing more protection from fiber migration. A 70/30 water/resin solution is applied to both surfaces (sides A and B) of the bonded, tacked nonwoven web, which is then heated to a temperature in excess of the glass transition temperature of the resin in the resin solution. This heating also serves to bond binder fibers (c) and binder fibers (d), thereby forming a bonded and lightly tacked nonwoven web. The batting intermediate is calendared at 170° C. to form the batting embodiment.

Fiber migration testing is performed on the batting embodiment according to the INS-17 Fiber Migration Test. Results of migration testing are as follows:

| | # Fibers Protruding Through Sample | | | | % Weight |
|---|---|---|---|---|---|
| | After Dry Cycle | After Laundering Cycle 1 | After Laundering Cycle 2 | After Laundering Cycle 3 | Loss of Batting After Laundering |
| Side A | 0 | 0 | 0 | 0 | 0% |
| Side B | 0 | 0 | 0 | 0 | |

Martindale testing is also performed on the batting embodiment. In particular, an unlaundered sample of the batting intermediate is covered with fabric, and is subjected to testing on the Martindale machine. Separate testing is performed rubbing the sample with fabric, seatbelt material, and backpack material, with results as follows:

| Insulation: 100 g Batting Embodiment | | | |
|---|---|---|---|
| | # Fibers Protruding Through Sample | | |
| Rubs | Fabric | Seatbelt | Backpack |
| 400 | 0 | 1 | 0 |
| 2000 | 0 | 1 | 0 |
| 3200 | 1 | 1 | 0 |
| 5000 | 2 | 1 | 0 |

As is readily apparent, the batting embodiment demonstrated exceptional performance despite the strenuous Martindale testing (typically not performed on batting insulation). The ability to achieve this level of reduced/prevented fiber migration in the bonded nonwoven batting comprising staple fibers is exceptionally advantageous.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present invention have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the invention.

The invention claimed is:

1. Batting comprising a bonded nonwoven web, said batting having a first surface parallel to a second surface, and said bonded nonwoven web comprising a fiber mixture containing, based on the total weight of the fiber mixture:

(a) 20 to 55 wt % of siliconized fibers having a denier of 1.5 to 10.0 and a length of 51 mm to 84 mm;

(b) 10 to 45 wt % of hollow conjugate fibers having a spiral crimp, and having a denier of 1.5 to 10.0 and a length of 51 to 84 mm;

(c) 10 to 45 wt % of a first population of binder fibers, said first population of binder fibers being elastomeric copolyester binder fibers having a denier of 1.5 to 8.0, a length of 51 mm to 84 mm, and a bonding temperature of 110° C. to 180° C.; and (d) 1 to 20 wt % of a second population of binder fibers different from the first population of binder fibers, said second population of binder fibers having a denier of 1.5 to 6.0, a length of 51 mm to 84 mm, and a bonding temperature of 80° C. to 135° C.;

wherein fibers in the fiber mixture are homogenously mixed.

2. The batting according to claim 1, wherein said first surface and said second surface comprise a resin.

3. The batting according to claim 2, comprising 4 to 15 wt % resin, based on the total weight of the batting.

4. The batting according to claim 3, comprising 6 to 10 wt % resin, based on the total weight of the batting.

5. The batting according to claim 1, wherein the fiber mixture comprises, based on the weight of the fiber mixture:

(a) 20 to 40 wt % of the siliconized fibers; and/or:

(b) 20 to 40 wt % of the hollow conjugate fibers; and/or (c) 20 to 40 wt % of the first population of binder fibers; and/or (d) 5 to 15 wt % of the second population of binder fibers.

6. The batting according to claim 1, wherein:

(a) the siliconized fibers have a denier of 3.0 to 10.0; and/or (b) the hollow conjugate fibers have a denier of 3.0 to 10.0; and/or (c) the first population of binder fibers have a denier of 3.0 to 8.0; and/or (d) the second population of binder fibers have a denier of 1.5 to 4.0.

7. The batting according to claim 1, wherein:

(a) the siliconized fibers are hollow.

8. The batting according to claim 1, wherein:

(b) the hollow conjugate fibers are dry fibers.

9. The batting according to claim 1, wherein:

(a) the siliconized fibers are polyester fibers.

10. The batting according to claim 9, wherein:

(a) the siliconized fibers are polyester fibers comprising recycled polyester.

11. The batting according to claim 1, wherein:

(b) the hollow conjugate fibers are polyester fibers.

12. The batting according to claim 11, wherein:

(b) the hollow conjugate fibers are polyester fibers comprising recycled polyester.

13. The batting according to claim 1, wherein:

(d) the second population of binder fibers comprise polyester.

14. The batting according to claim 13, wherein:

(d) polyester in the second population of binder fibers comprises recycled polyester.

15. The batting according to claim 1, having an area weight of 25 to 60 g/m$^2$ and a density of 11 to 15 kg/m$^3$.

16. The batting according to claim 1, having:

a warmth per weight thermal performance greater than 0.012 clo per g/m$^2$ according to ISO11092; and/or a water uptake property of less than 150 wt %.

17. The batting according to claim 1, having a migration resistance of less than 20 fibers when tested according to the INS-17 Fiber Migration Test.

18. An article comprising the batting according to claim 1.

19. The article according to claim 18, wherein said article is selected from the group consisting of an outerwear product, clothing, a sleeping bag, and bedding.

20. A method of making the batting according to claim 1, said method comprising:

preparing the fiber mixture by mixing:

(a) 20 to 55 wt % of siliconized fibers having a denier of 1.5 to 10.0 and a length of 51 mm to 84 mm;

(b) 10 to 45 wt % of hollow conjugate fibers having a spiral crimp, and having a denier of 1.5 to 10.0 and a length of 51 to 84 mm;

(c) 10 to 45 wt % of a first population of binder fibers, said first population of binder fibers being elastomeric copolyester binder fibers and having a denier of 1.5 to 8.0, a length of 51 mm to 84 mm, and a bonding temperature of 110° C. to 180° C.; and (d) 1 to 20 wt % of a second population of binder fibers different from the first population of binder fibers, said second population of binder fibers having a denier of 1.5 to 6.0, a length of 51 mm to 84 mm, and a bonding temperature of 80° C. to 135° C.;

forming a nonwoven web from the fiber mixture;

providing the nonwoven web, or optionally layering the nonwoven web formed from the fiber mixture with one or more additional nonwoven webs;

heating the nonwoven web(s) to or in excess of a highest binder fiber bonding temperature, thereby forming batting or a batting intermediate comprising one or more nonwoven webs, including at least the bonded nonwoven web comprising the fiber mixture, said batting or batting intermediate having a first surface parallel to a second surface;

optionally applying a resin solution to the first and second surfaces of the batting intermediate;

optionally heating the batting intermediate to a temperature in excess of the glass transition temperature of the resin in the resin solution; and optionally calendaring one or more surface of the batting intermediate, thereby forming the batting.

* * * * *